US006837686B2

(12) United States Patent
Di Paola et al.

(10) Patent No.: US 6,837,686 B2
(45) Date of Patent: Jan. 4, 2005

(54) BLADE RETENTION SCHEME USING A RETENTION TAB

(75) Inventors: Franco Di Paola, Montreal (CA); Eugene Gekht, Brossard (CA)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 10/255,666

(22) Filed: Sep. 27, 2002

(65) Prior Publication Data

US 2004/0062653 A1 Apr. 1, 2004

(51) Int. Cl.[7] ..... F01D 5/32
(52) U.S. Cl. ..... 416/220 R; 416/204; 416/248
(58) Field of Search ..... 416/220 R, 221, 416/204 A, 248; 29/889.2

(56) References Cited

U.S. PATENT DOCUMENTS

| | | | | |
|---|---|---|---|---|
| 2,641,443 A | | 6/1953 | Comery et al. | |
| 2,761,648 A | | 11/1956 | Purvis | |
| 2,786,648 A | * | 3/1957 | Ledwith | 416/221 |
| 2,847,187 A | | 8/1958 | Murphy | |
| 2,928,651 A | | 3/1960 | Turnbull | |
| 2,971,744 A | | 2/1961 | Szydlowski | |
| 3,045,329 A | * | 7/1962 | Carli et al. | 29/889.21 |
| 3,216,699 A | | 11/1965 | Schoenborn | |
| 3,383,095 A | | 5/1968 | Anderson | |
| 3,597,112 A | * | 8/1971 | Garten | 416/205 |
| 3,598,503 A | | 8/1971 | Muller | |
| 3,986,779 A | | 10/1976 | Beckershoff | |
| 4,102,602 A | | 7/1978 | Rottenkolber | |
| 4,221,542 A | | 9/1980 | Acres | |
| 4,501,095 A | * | 2/1985 | Drinkuth et al. | 451/5 |
| 5,302,086 A | | 4/1994 | Kulesa et al. | |
| 5,431,543 A | | 7/1995 | Brown et al. | |
| 5,518,369 A | | 5/1996 | Modafferi | |
| 6,109,877 A | | 8/2000 | Gekht et al. | |

FOREIGN PATENT DOCUMENTS

| | | |
|---|---|---|
| DE | 32 36 021 | 5/1983 |
| DE | 198 23 157 | 11/1999 |

* cited by examiner

*Primary Examiner*—Ninh H. Nguyen
(74) *Attorney, Agent, or Firm*—Ogilvy Renault

(57) ABSTRACT

A blade retention system for retaining blade roots in slots of a rotor hub disk, the rotor blade having a radially outward blade tip requiring surface material removal by grinding to acquire a finished ground surface, having a blade root retention tab with an elongated web of thickness less than the gap between the slot and blade root and with at least two deformable protrusions extending radially to a height exceeding said gap, the protrusions adapted to deform under compression radially inwardly on sliding engagement with the blade root in the slot and to exert a reaction force radially outwardly on the blade root of a magnitude sufficient to secure the blade tip during surface removal grinding of the blade tip against radial displacement and against rotational displacement.

8 Claims, 5 Drawing Sheets

BLADE RETENTION SCHEME USING A RETENTION TAB

TECHNICAL FIELD

The invention relates to a blade retention system with retention tab for securing blades to a rotor in a gas turbine engine.

BACKGROUND OF THE ART

Turbine rotors and compressor rotors include individually removable blades that are conventionally mounted in a peripheral array of individually manufactured blades in interlocking slots in the rotor disc that match the blade roots. High rotational speeds require that the blades be securely mounted and blades are exposed to high temperature variations during operations as well as axial loading from flow of gas over the air foiled and platform surfaces. Individual blades are periodically removed during repairs and inspection. Preferably any blade locking mechanism is installed and rapidly removed with no damage to the rotor hub and blade root.

Many different types of locking devices are provided in the prior art. One low cost method of retaining small blades is with counter sunken rivets, which extend through the slot. The riveting operation on the bladed disk assembly is unreliable and frequently requires rework. Riveting machines are relatively expensive and limit the location where the work can be performed. Inconsistent load is applied by the crushed rivet and therefore the radial load on the blade varies depending on the installation.

Even when complex blade root locking systems are used, at times the blades loosen during grinding of the blade tips thereby creating variations in the outer rotor assembly diameter. Since blade tip clearance is of critical importance in maintaining the efficiency of the engine, variation in the outer rotor assembly diameter is undesirable.

As well, rivets have been known to develop insufficient axial resistance to the axial loads imparted on the blades and allow the blades to slide within the slots in the rotor and thereafter rub against adjacent components causing contact damage.

Many of the blade retention systems of the prior art involve relatively complex and expensive interlocking components that are not readily removed during repair operations. Some systems provide a resilient radial outward force that is variable and do not adequately support the blade roots radially during grinding of the blade tips.

It is an object of the present invention to provide a simple inexpensive blade retention scheme that adequately supports the blade during grinding operations of the blade tip.

It is a further object of the invention to provide a retention scheme that supports the blade with sufficient radial load to grind the rotor assembly without use of complex tooling or the need for high speed grinding.

Further objects of the invention will be apparent from review of the disclosure, drawings and description of the invention below.

DISCLOSURE OF THE INVENTION

The invention provides a blade retention system, for use with a rotor hub disk with peripheral circumferential array of spaced apart blade retention slots extending between the forward and rearward hub faces, each slot having a radially inward floor and side walls adapted for sliding engagement with a blade root of a rotor blade. The blade root has a bottom surface which when engaged in the slot, is radially spaced from and adjacent the slot floor thus defining a gap extending between the forward and rearward hub faces at said selected broach angle. The blade root retention tab has an elongated web with a thickness less than said gap and including a preformed transverse flange extending from a first end of the web and a second end that extends from the slot and is bent on installation into an installation flange. The web is adapted to be disposed in the gap when the web rests on the slot floor to permit sliding engagement of the blade root in the slot while the preformed flange engages one of the forward and rearward faces of the rotor hub disk. The web of the tab includes at least two deformable protrusions extending radially to a height exceeding the gap, so that the protrusions deform on sliding engagement with the blade root in the slot and secure the blade radially outward during grinding of the tip for example.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
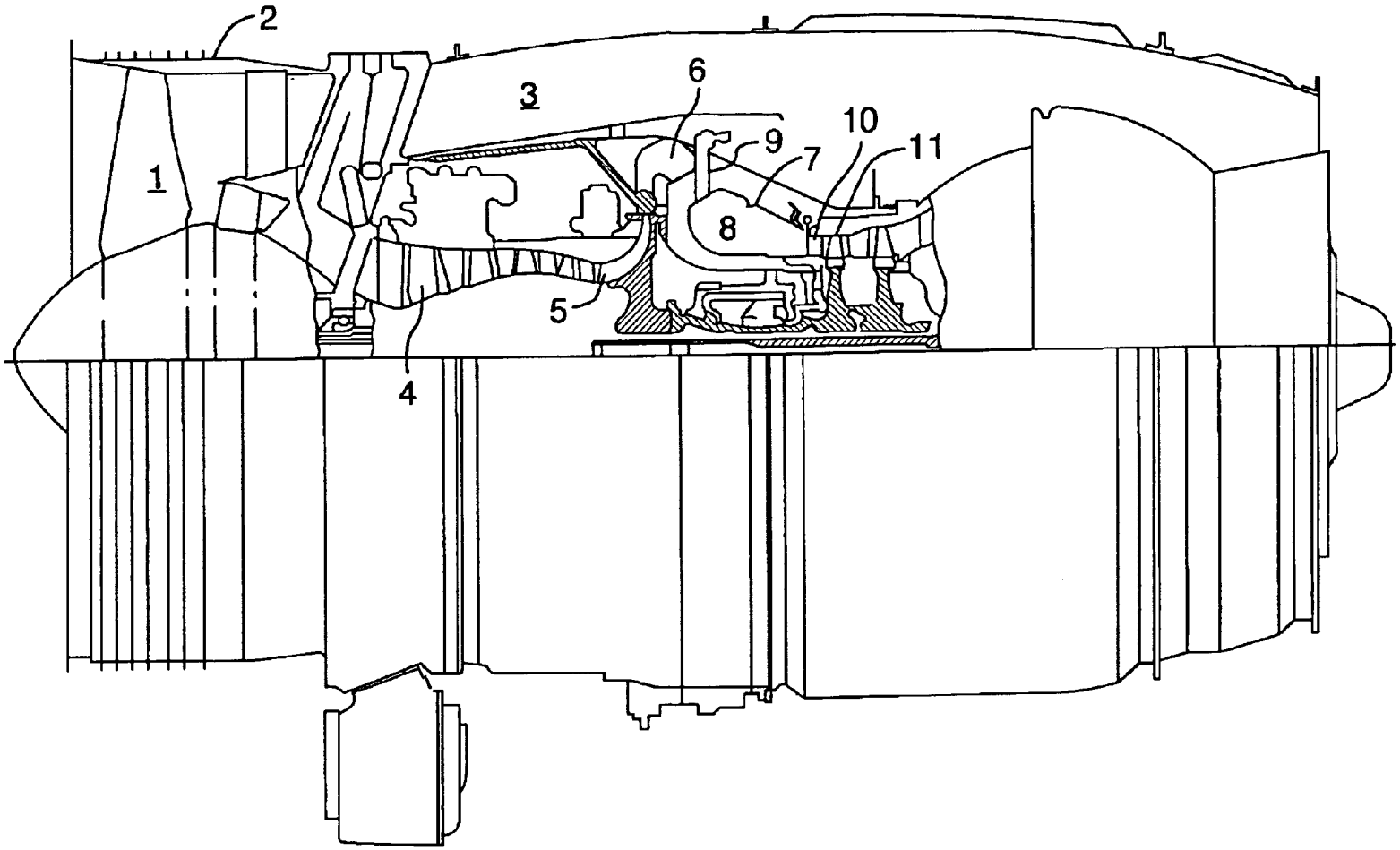
FIG. 1 is an axial cross-sectional view through a turbo fan gas turbine engine illustrating the basic components of the engine and specifically the location of rotors and blades to which the invention applies.

FIG. 1 shows an axial cross-section through a turbo-fan gas turbine engine. It will be understood however that the invention is equally applicable to any type of engine with a compressor and turbine section such as a turbo-shaft, a turbo-prop, or auxiliary power units. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

Figure 2:
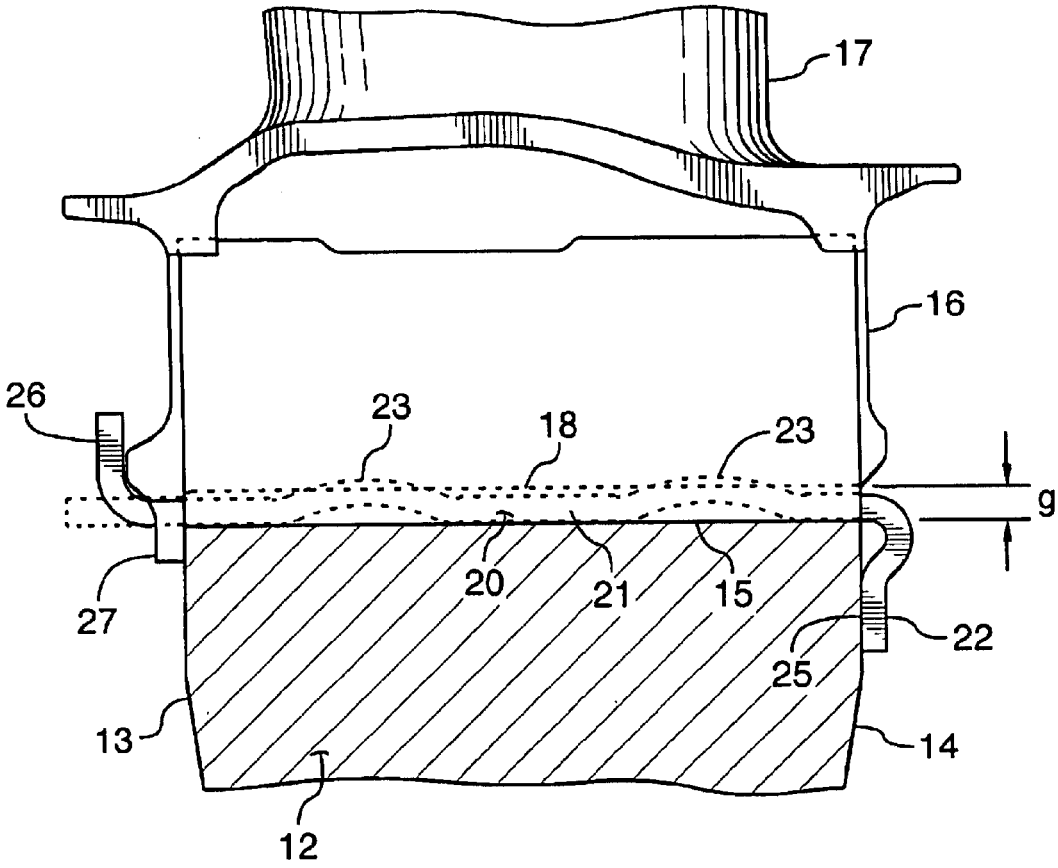
FIG. 2 is an axial cross-sectional view through the blade root mounted in the slot of a rotor in accordance with the invention using the retention tab with two deformable protrusions as shown in dashed outline.
Figure 3:
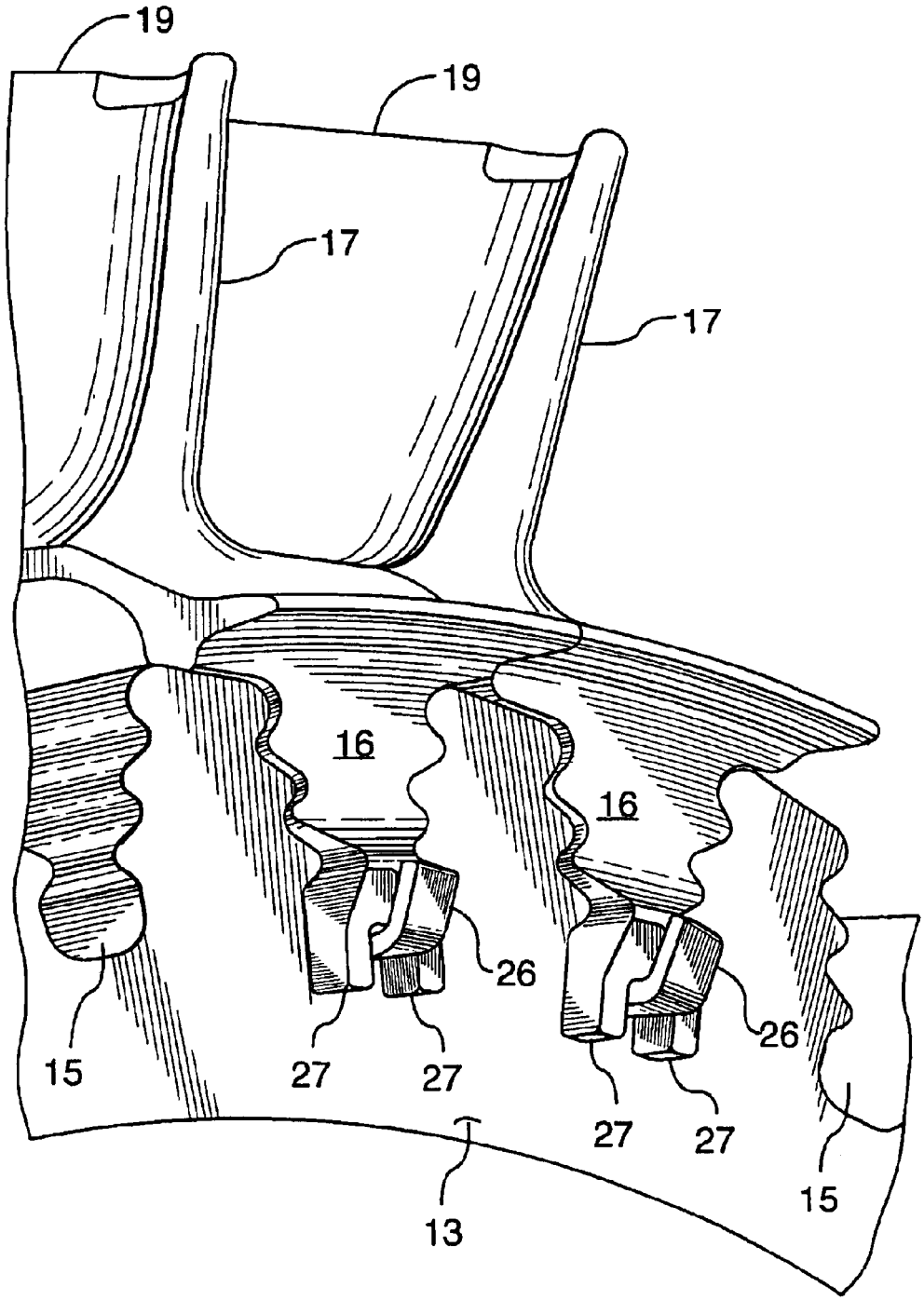
FIG. 3 is a perspective view of a segment of the forward face of the hub included to installed blades.
Figure 4:
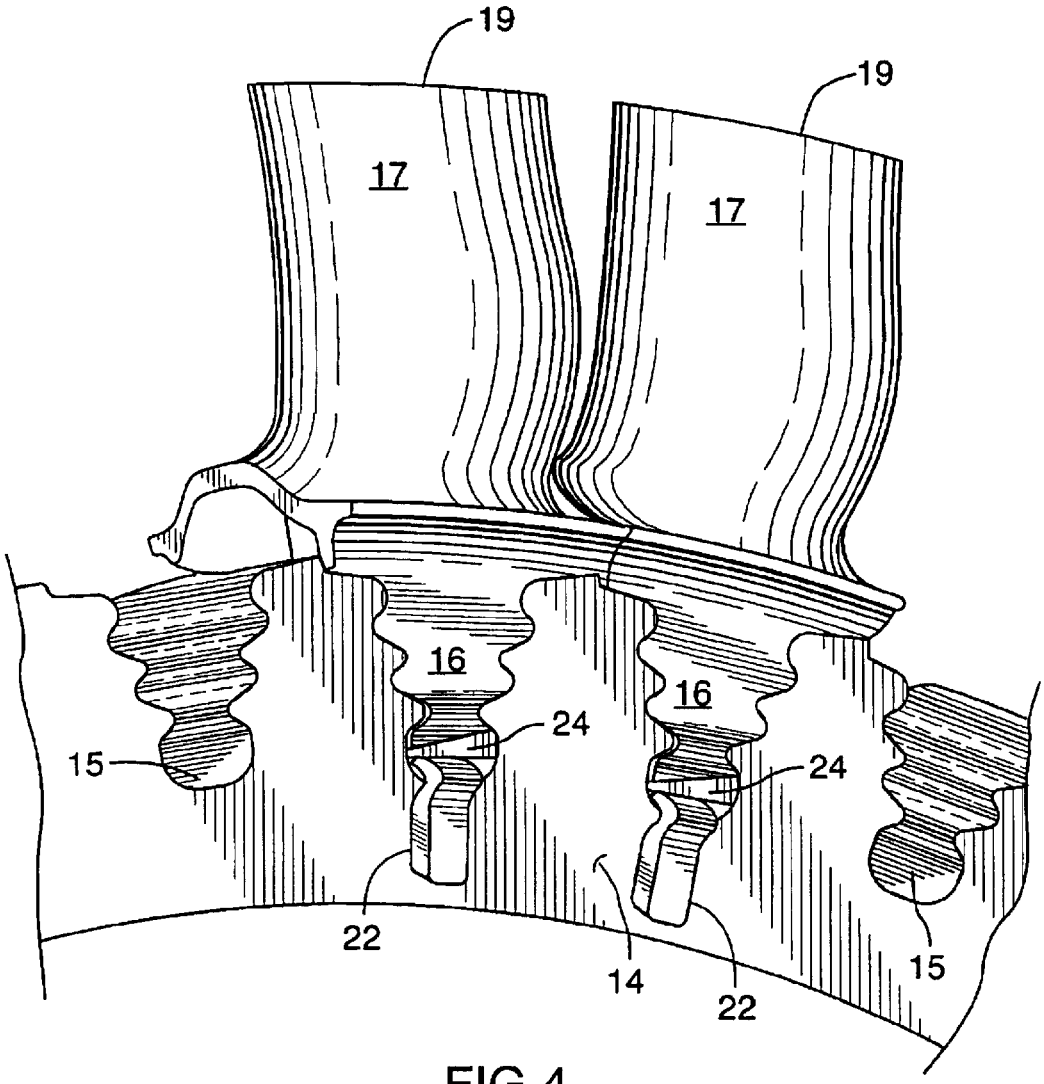
FIG. 4 is a perspective view of a segment of the aft face of the hub.

FIG. 2 shows details of the blade retention system for use in a rotor assembly such as a compressor or turbine rotor for example. As shown in FIGS. 2, 3 and 4, the rotor hub disk 12 has a thickness between the forward face 13 and rearward face 14 with a peripheral circumferential array of spaced apart blade retention slots 15 extending between the forward and rearward hub faces 13 and 14 at a selected broach angle β as is conventional. Each slot 15 had a radially inward wall and side walls adapted for sliding engagement with the blade root 16 of a blade 17. The root 16 also has lateral sides disposed at the broach angle β and includes a bottom surface 18 which when engaged in the slot 15 is radially spaced from and adjacent the slot 4 floor thus defining a gap "g" as shown in FIG. 2 extending between the forward and rearward faces 13 and 14 at the selected broach angle β.

In order to retain the blade root 16 and exert a radially outward force sufficient to maintain the position of the blade 17 during grinding of its tip 19, the invention provides a novel blade root retention tab 20. The details of the tab are illustrated best in FIGS. 5, 6 and 7. The tab 20 has an elongated web 21 having a thickness "t" that is less than the gap "g". The tab includes a preformed transverse flange 22 that extends from a first end of the web 21. As best shown in FIG. 2, the web 21 is adapted to be disposed in the gap "g" when the web 21 rests on the slot floor to permit sliding engagement of the blade root 16 into the slot 15. In the embodiment shown, the preformed flange 22 engages the rearward face 14 of the rotor hub disk 12. However, it will be understood that the arrangement can be easily reversed such that the flange 22 engages the forward face 13.

Figure 5:
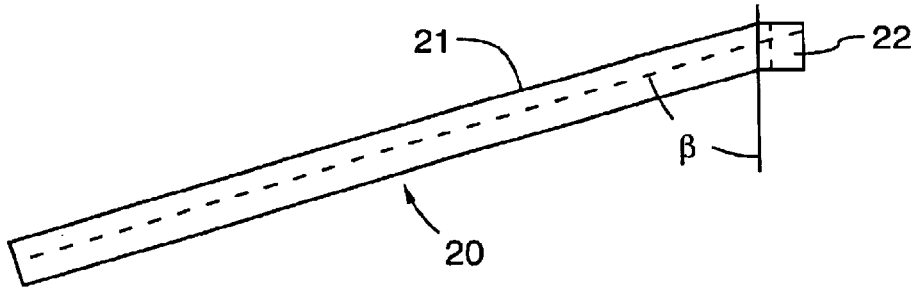
FIG. 5 is a plan view of an individual retention tab.
Figure 6:
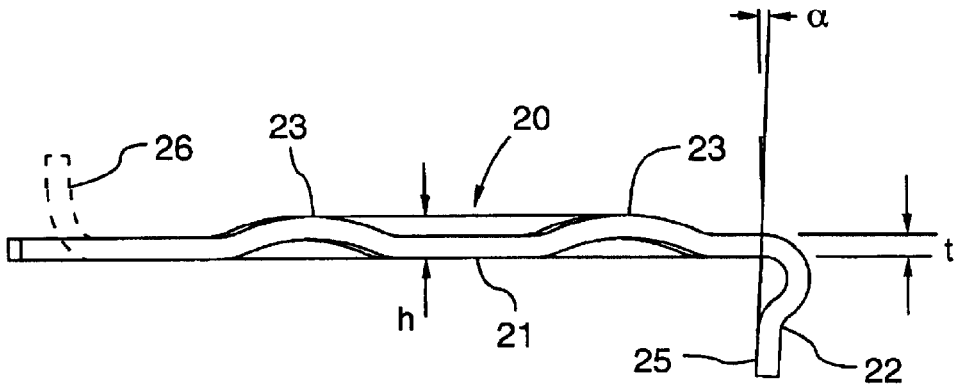
FIG. 6 is an elevation view of the retention tab.
Figure 7:
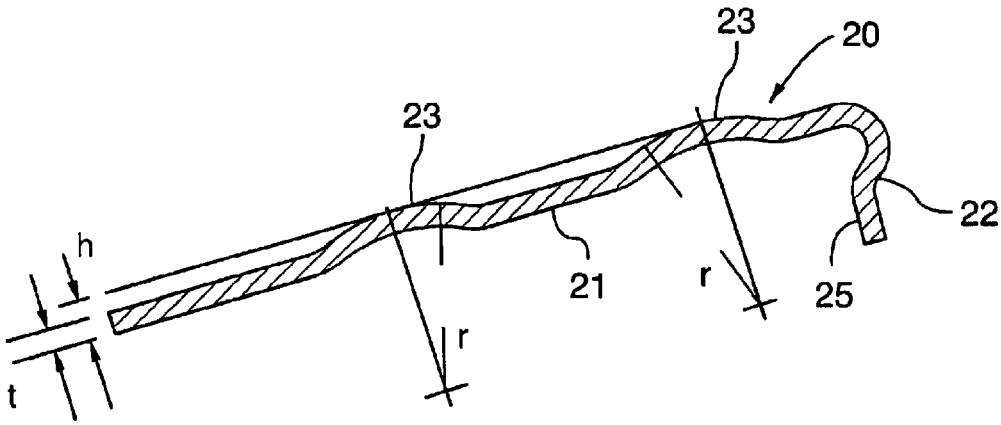
FIG. 7 is a cross-sectional view through the retention tab to show the details of the protrusions.

As shown in FIGS. 5, 6 and 7, the web 21 includes at least two deformable protrusions 23 that extend radially to a height "h" that exceeds the dimension of the gap "g". As shown in FIG. 2 in dashed outline, the protrusions 23 before installation of the blade root 16 extend upwardly, however once the blade root 16 slides over the tab 20, the protrusions 23 are deformed and pressed radially inwardly resulting in an interference fit. As shown in FIG. 4, the blade root 16 preferably includes a chamfer 24 on the leading edge which is oriented transverse to the broach angle β to apply an evenly distributed force to guide the deformation of the protrusions 23.

Referring to FIGS. 5, 6 and 7, in the embodiment shown the tab 20 includes two protrusions 23 that are symmetrically spaced apart from a mid point of the web 21. However it will be understood that any number of protrusions 23 can be provided preferably in a symmetrical pattern in order to enhance the even distribution of force to hold the blade roots 16 during grinding of the blade tip 19. The protrusions 23 as illustrated in the embodiment of FIGS. 6 and 7 are simple undulations of the web 21 formed by a press for example with a central portion of the protrusion 23 having a constant radius of curvature "r" as illustrated in FIG. 7. As shown in FIG. 6, the preformed flange 22 is resiliently biased by over bending through an angle α such that the rotor surface engagement pad 25 remains in contact with the rearward face 14. As illustrated in dashed outline in FIGS. 6–7 and in solid outline in FIG. 2, the initially straight second end of the web 21 is bent into an installation flange 26 once the blade root 16 is in place. To prevent relative axial movement between the blade roots 16 and the rotor hub disk 12 on installation, the blade root 16 includes a trailing edge with rotor engagement abutments in the form of two fingers 27 that straddle the end of the web 21 in the installed position as best seen in FIGS. 3 and 2. In the installed position, the installation flange 26 is bent parallel to the two fingers 27 in an opposite direction. As a result, forward or rearward movement of the blade root 16 relative to the rotor hub disk 12 is prevented by interference with flanges 22 and 26 or fingers 27.

Therefore, on installation the radially extending protrusions 23 incorporated into the retention tab 20 provide sufficient radial load to permit grinding of the blade tips 19 of the rotor assembly without the use of complex tooling or the need for high speed grinding. The interference induced by the protrusions 23 and the bent flanges 22 and 26 provide sufficient load to prevent the blade roots 16 from releasing from the slots 15 and in forward direction. The abutment fingers 27 prevent rearward axial motion of the blade root 16 within the slots 15.

The retention tab 20 is designed with a width and thickness "t" to fit within the slots 15 in the rotor hub 12. The preformed flange 22 engages either the forward or rearward face 13, 14 of the rotor hub disk 12. Preferably, the slot 15 has a flat bottom matching the shape of the retention tab 20. An elliptical shape for the bottom floor of the slot 15 would minimize stress in the rotor hub 12, but on contact with a flat retention tab 20 would promote damage due to the line contact with the edges of the tab 20.

The assembly procedure requires simple tooling as follows. The rotor hub 12 is installed into its backing plate (not shown). The retention tab 20 is inserted into position in the slot 15 and held in place as the retention tab 20 is compressed forward with the backing plate. The backing plate also provides support for the retention tab 20 against buckling while inserting the blade root 16 in a sliding motion within the slot 15. The blade roots 16 are installed by sliding them axially over the retention tabs 20 and deformable protrusions 23. The two fingers 27 that are cast in the blade root 16 ensure that blades 17 are installed in the proper orientation in a mistake proof manner. The blade root 16 slides within the slot 15 and scratching of the rotor hub disk 12 is eliminated since movement is between the blade root 16 and the retention tab 20.

Preferably, the leading edge of the blade root 16 includes a chamfer 24 normal to the broach angle β to ease transition over the deformable protrusions 23, thereby facilitating assembly of the blade roots 16 into the slots 15. Once the two fingers 27 of the blade root 16 abut the rotor hub 12, the other end of the tab 20 may be bent upwardly to form an installation flange 26 and complete the assembly.

Spring back of the flange 26 is minimized through use of low ductility material for the tabs 20. Bending of the tab 20 during installation can be performed with a soft mallet or a roller with hydraulic tooling. Assembly time is reduced significantly in comparison to riveting for example.

Although the above description relates to a specific preferred embodiment as presently contemplated by the inventors, it will be understood that the invention in its broad aspect includes mechanical and functional equivalents of the elements described herein.

What is claimed is:

1. A blade retention system, for use in a rotor assembly including a rotor hub disk having a thickness, a forward face and a rearward face with a peripheral circumferential array of spaced apart blade retention slots extending between the forward and rearward hub faces at a selected broach angle thereto, each slot having a radially inward floor and side walls adapted for sliding engagement with a blade root of a rotor blade, the root having lateral sides disposed at said broach angle to forward and rearward root surfaces, wherein the blade root has a bottom surface which when engaged in said slot, is radially spaced from and adjacent the slot floor thus defining a gap extending between the forward and rearward hub faces at said selected broach angle, the improvement characterised in that the blade retention system includes: a blade root retention tab having an elongated web having a thickness less than said gap and including: a preformed transverse flange extending from a first end of the web, the web adapted to be disposed in the gap when the web rests on the slot floor to permit sliding engagement of the blade root in the slot, the preformed flange adapted to engage one of the forward and rearward faces of the rotor hub disk; wherein the web of the tab includes at least two deformable protrusions extending radially to a height exceeding said gap, the protrusions adapted to deform on sliding engagement with the blade root in the slot; and wherein the blade root includes a chamfered leading edge.

2. A blade retention system according to claim 1 wherein the chamfered leading edge is oriented transverse said broach angle.

3. A blade retention system, for use in a rotor assembly including a rotor hub disk having a thickness, a forward face and a rearward face with a peripheral circumferential array of spaced apart blade retention slots extending between the forward and rearward hub faces at a selected broach angle thereto, each slot having a radially inward floor and side walls adapted for sliding engagement with a blade root of a rotor blade, the root having lateral sides disposed at said broach angle to forward and rearward root surfaces, wherein the blade root has a bottom surface which when engaged in said slot, is radially spaced from and adjacent the slot floor thus defining a gap extending between the forward and rearward hub faces at said selected broach angle, the improvement characterised in that the blade retention system includes: a blade root retention tab having an elongated web having a thickness less than said gap and including: a preformed transverse flange extending from a first end of the web, the web adapted to be disposed in the gap when the web rests on the slot floor to permit sliding engagement of the blade root in the slot, the preformed flange adapted to engage one of the forward and rearward faces of the rotor hub disk; wherein the web of the tab includes at least two deformable protrusions extending radially to a height exceeding said gap, the protrusions adapted to deform on sliding engagement with the blade root in the slot; and wherein the blade root includes a trailing edge with a rotor engagement abutment.

4. A blade retention system according to claim 3 wherein the rotor engagement abutment comprises two fingers adapted to straddle a second end of the web in an installed position.

5. A blade retention system according to claim 4 wherein the second end of the web includes an installation flange bent parallel to the two fingers.

6. A method of grinding tips of turbine blades in a rotor assembly, the rotor assembly including a rotor disk and a plurality of turbine blades, the rotor disk having a forward face, a rearward face and a plurality of peripheral slots extending angularly between the forward and rearward faces, each slot having a radially inward slot floor and adapted receive a blade root of a turbine blade, the blade root and slot floor defining a gap therebetween when the blade root is installed in the slot, the gap extending substantially between the forward and rearward faces, the method comprising the steps of:

installing a blade root retention tab in the slot between each blade root and each slot floor of the rotor assembly, the tab having an elongated web having a thickness less than said gap and including a preformed transverse flange extending from a first end of the web, the web adapted to be disposed in the gap when the web rests on the slot floor to permit sliding engagement of the blade root in the slot, the preformed flange adapted to engage one of the forward and rearward faces of the rotor hub disk; the web of the tab including at least two deformable protrusions extending radially to a height exceeding said gap, the protrusions adapted to deform on sliding engagement with the blade root in the slot; and grinding the tips of the blades while the protrusions of the retention tabs exert at least two axially spaced apart reaction forces directed radially outwardly on the blade root of a magnitude sufficient to secure the blade root during surface removal grinding of the blade tip, against radial displacement and against rotational displacement in said slot.

7. A method according to claim 6 wherein the two protrusions are symmetrically spaced apart from a midpoint of the web, whereby the blade root is secured against rotation about said midpoint during grinding.

8. A method according to claim 6 wherein the protrusions comprise an undulation of the web having a central portion of constant radius of curvature.

* * * * *